United States Patent [19]

Herrin

[11] Patent Number: 4,926,964

[45] Date of Patent: May 22, 1990

[54] STEP/EXTENSION LADDER

[76] Inventor: Danny R. Herrin, 4835 Yale St., Metairie, La. 70062

[21] Appl. No.: 402,561

[22] Filed: Sep. 5, 1989

[51] Int. Cl.[5] ..... E06C 1/18; E06C 1/12

[52] U.S. Cl. ..... 182/22; 182/166; 182/209

[58] Field of Search ..... 182/21, 22, 26, 166, 182/167, 207, 209

[56] References Cited

U.S. PATENT DOCUMENTS

| | | | |
|---|---|---|---|
| 408,281 | 8/1889 | Wright | 182/166 |
| 489,059 | 1/1893 | Wieland | 182/166 |
| 535,082 | 3/1895 | Snell | 182/21 |
| 763,209 | 6/1904 | Schwalbe | 182/166 |
| 860,065 | 7/1907 | Scott | 182/22 |
| 943,511 | 12/1909 | Burgstaller | 182/22 |
| 989,570 | 4/1911 | Cooper | 182/22 |
| 1,441,529 | 1/1923 | Saccone | 182/166 |
| 3,768,592 | 10/1973 | Higgins | 182/22 |
| 4,155,422 | 5/1979 | Larson | 182/166 |

*Primary Examiner*—Reinaldo P. Machado
*Attorney, Agent, or Firm*—Thomas S. Keaty

[57] ABSTRACT

This invention relates to a convertible step/extension ladder which allows to use one or more of extension sections with a basic A-shaped ladder frame. The extension sections are slidably mounted on legs of the frame through the use of housing/sliding rail arrangement on the legs of the frame and on the extension sections. When converted to an extension ladder, the basic frame portions are folded and locked in that position, while one extension section is moved along the frame portion to rest on the ground. If more than one extension sections are used, the second extension section is mounted on the opposite frame portion and extended upwardly, so that the basic frame portions form a middle part of the ladder.

14 Claims, 3 Drawing Sheets

STEP/EXTENSION LADDER

BACKGROUND OF THE INVENTION

The present invention relates to ladders, and more specifically to a combination step/extension ladder which may be arranged in an extension ladder configuration or, with the slightest of ease, can be transformed into a step ladder configuration.

There are a variety of different forms of ladders used in today's industry, these include aerial ladders, step ladders, extension ladders (lean to ladders) and accommodation ladders. Of these, the most commonly used ladders are the step and extension ladders. The extension ladder is basically a "lean to" ladder which is comprised of a multitude of sections which telescopically extend the length of the ladder. This ladder is supported by leaning it up against a structure, such as a wall, with its base firmly planted on the ground. On the other hand, the step ladder is generally a folding type structure which, unlike the extension ladder, is self-supporting (because of its A-frame structuring).

There are a number of ladders which are constructed to combine the principles of the step ladder with those of the extension ladder. See, e.g., U.S. Pat. Nos. 274,526; 830,485; 1,401,257; 1,691,976; 2,899,008; and 4,376,470.

Generally, these combination ladders are constructed in two different manner: one is to have the two sections of the ladder pivot about a hinge at the top of the step, such that when folded out it is used as an extension ladder, and when folded inward, to a basic A-frame, it is used as a step ladder; the second manner of construction maintains the ladder in basically the step ladder construction (A-frame) wherein the rungs are extended upward by sliding the step ladder upward while still keeping the A-frame feature.

There are many drawbacks to these prior designs for combination step/extension ladders. For example, in the construction which pivots about a hinge, the structure is not considered very stable. The stresses imposed on the hinge is very high and this design allows the extended ladder to wobble considerably more at this hinge/flexure point. Also, the previous design do not consider the angle of the rungs on the inverted section, thereby causing an unsafe ascent for the person using the ladder. The rungs should be constructed such that the rungs are constant, that is they do not change in shape or structure. A change in the rung, angle or size is generally not anticipated by one using a ladder, therefore the change in the rung may cause an accident for an unwary user.

Further, problems with the A-frame constructed step/extension ladder are associated with safety as well. One major problem revolves around the need to adjust the bottom width of the A-frame. In extending the ladder height the previous design require that the A-frame be widened by readjusting the spreader strap which hold the legs of the A-frame together. This does not allow for stable construction of the A-frame, because there is an increase in the chances for failure at the spreader strap and constant changes at this point would cause some degree of fatigue to whatever material is used.

It is toward the solution of these inherent problems that the present invention is directed.

SUMMARY OF THE INVENTION

The present invention provides a safe and convenient ladder which can be used as a step ladder or an extension ladder, wherein the transformation of one use to another is simple and safe.

The device of the present invention provides for the use of a step ladder having all necessary features associated with step ladders. E.g. solid construction and design, a painter's ledge for storing tools and supply while using the ladder, a safe and useful top rung, and solid spreader bar.

Slidably attached to the exterior of the legs of the step ladder are extension sections/legs. When using the ladder as an extension ladder, the legs are folded together and locked in place by a locking pin. The extension sections/legs are then released from their locked position, and are slidably extended to the desired length, and then locked into that position. These extension sections/legs are constructed such that additional extension members may be added to the existing members sliding them onto the present extension section and locking into place. There is provided a sliding rail system wherein a generally T-shaped member is encased, in a sliding manner, by a housing which surrounds the T-shaped member, such that the housing is allowed to slidably run the length of the extension leg/section.

It is, therefore, an object of the present invention to provide a combination step/extension ladder which is safe and sturdily constructed.

It is a further object of the present invention to provide a combination step/extension ladder which can be indefinitely extended in a convenient and sturdy manner.

It is still a further object of the present invention to provide a convenient and easy locking mechanism to secure the legs/extension sections to each other.

These and other objects of the present invention will be apparent to those skilled in the art from the following description of the invention.

BRIEF DESCRIPTION OF THE DRAWINGS

Referring now to the drawings.

DETAILED DESCRIPTION OF THE PREFERRED EMBODIMENT

Figure 1:
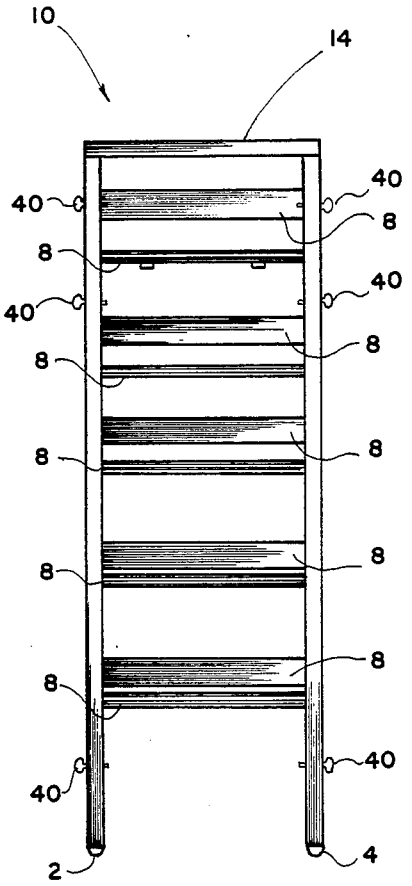
FIG. 1 illustrates front view of the improved combination step/extension ladder device in accordance with the present invention.

Referring to the drawings in more detail, the convertible step/extension ladder of the present invention is designated by numeral 10 in the drawings. The ladder 10 comprises a main step ladder frame 12 and one or more of extension sections 30. In the embodiment illustrated in FIGS. 2, 3 and 5 a pair of extension sections 30 is seen.

The main frame 12 is comprised of a first portion 16 and a second portion 18, the latter being adapted for a limited pivotal movement about an axis of a hinge pin 13 which engages an upper part of the second frame portion 18.

Figure 2:
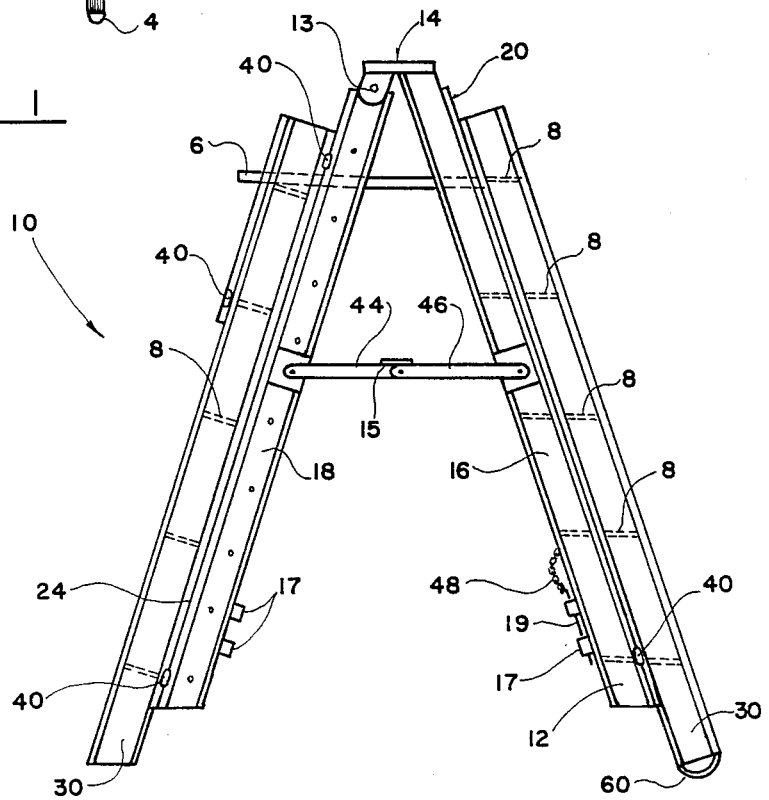
FIG. 2 is a side elevational view of the improved combination step/extension ladder device in accordance with the present invention illustrating use as a step ladder.

The hinge pin 13 forms a part of the hinge 15 which is also attached to a top rung 14 connecting upper part of the first and second frame portions 16 and 18. The second portion 18 is thereby allowed to pivot towards the first portion 16, when the ladder is in its folded position or used as an extension ladder, or to pivot away from the first portion 16 when used as a step ladder, as illustrated in FIG. 2.

The structure of the first and second portions 16 and 18 is very similar in that both portions have a pair of parallel legs 2 and 4 spaced from each other and connected by a plurality of transverse rungs 8 which are preferably equidistantly spaced from each other.

Figures 3, 4:
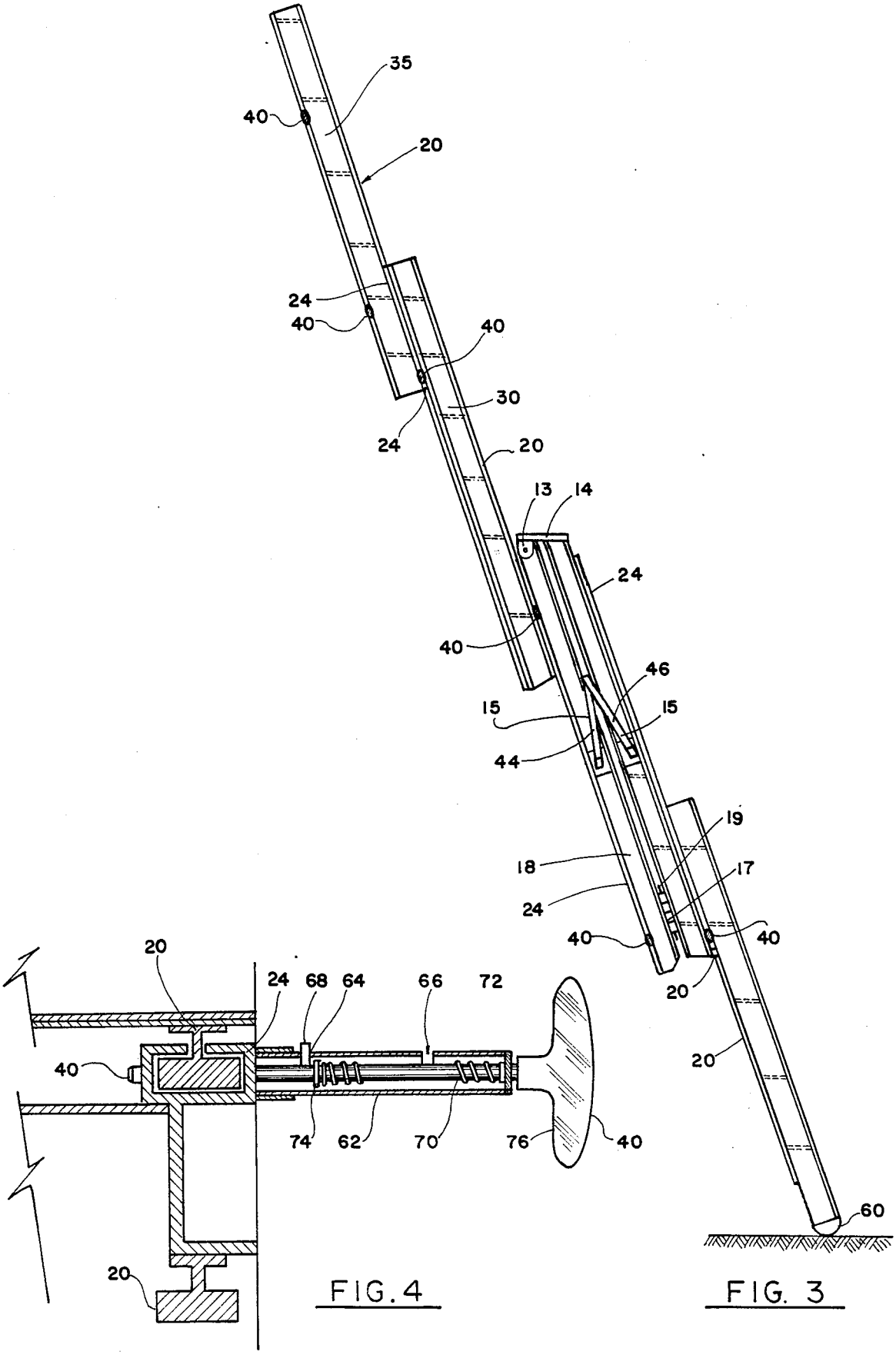
FIG. 3 a side elevational view of the improved combination step/extension ladder device in accordance with the present invention illustrating use as an extension ladder.
FIG. 4 is a cross-sectional view of the locking pin of the rail system of the improved combination step/extension ladder device in accordance with the present invention.
Figure 5:
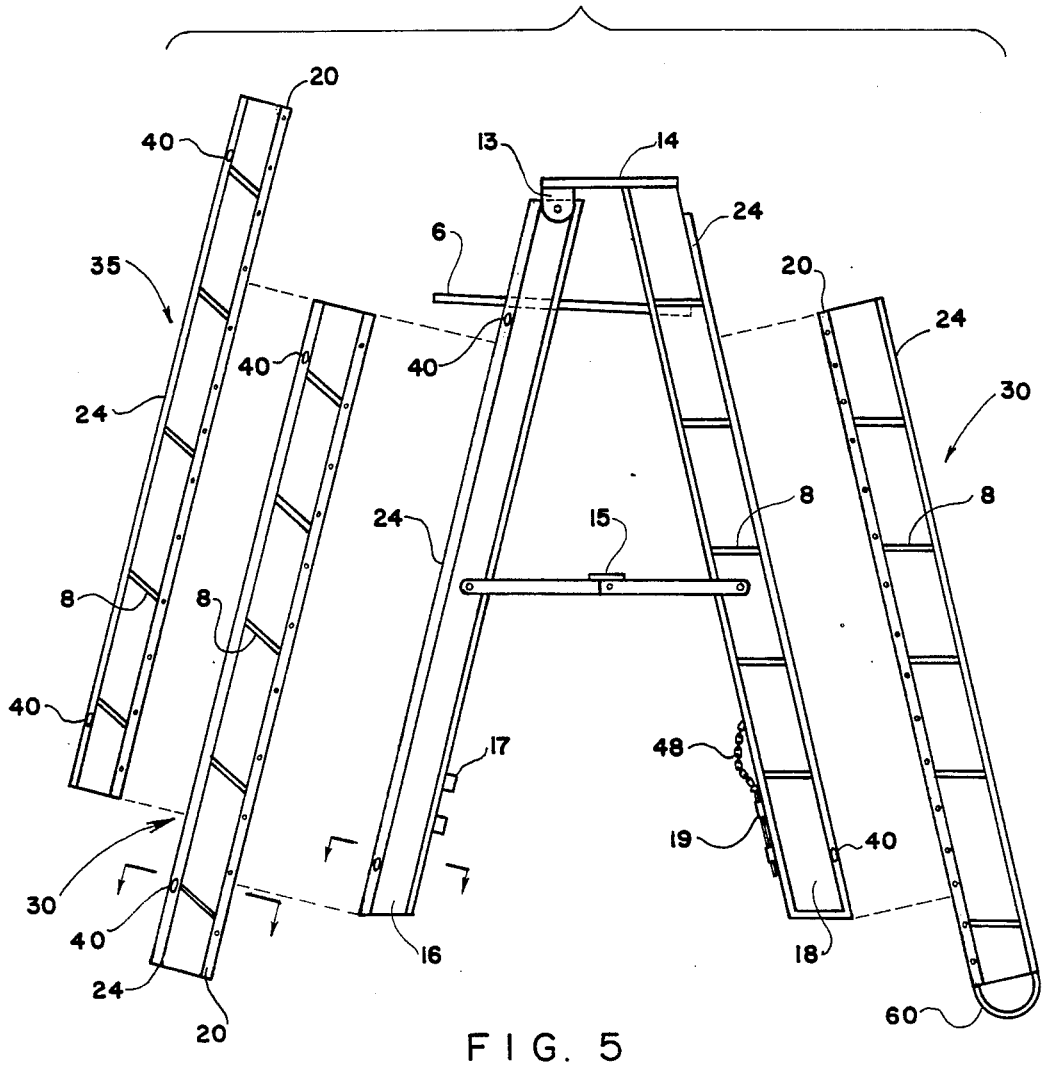
FIG. 5 is an exploded view of the device claimed in FIG. 2 above.
Figure 6:
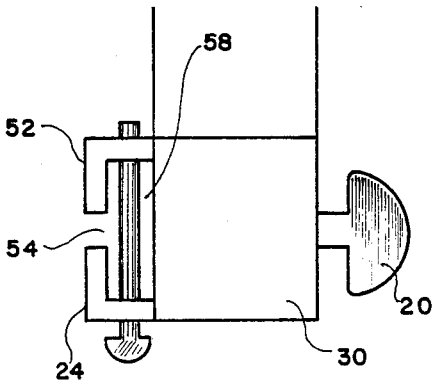
FIG. 6 is a cross-sectional view of a leg of the extension member of the step/extension ladder device as claimed 10 in FIGS. 1, 2 and 3.
Figure 7:
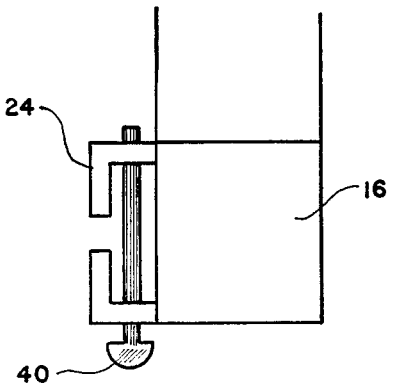
FIG. 7 is a cross-sectional view of a leg member of the step/extension ladder.

When the ladder 10 is used as a step ladder, two conventional securing bars 15 pivotally attached at its opposite ends to the first and second portions 16 and 18 at about midsection from the legs 2 and 4, prevents the portions 16 and 18 from separating from each other, instead forming an A-frame ladder. The securing bar 15 is formed of two bar sections 44 and 46, which are pivotally connected together to allow folding of the frame as illustrated in FIG. 3. When in use, a conventional locking means allows locking of the bar sections 44 and 46 to secure the spread position of the portions 16 and 18.

A pair of locking pin receiving tubular members 17 are fixedly attached to a lower part of portion 18. The tubular members 17 are vertically spaced from each other and are each formed with a central opening permitting engagement of a locking pin 19 therein. A similar pair of tubular members 17 are fixedly attached to a lower part of portion 16 at a level slightly displaced from the level of the tubular members 17 of the portion 18. When brought in close proximity to each other, the tubular members 17 of both portion 16 and 18 form one elongated tubular member with co-aligned central openings through which the pin 19 is inserted to retain portions 16 and 18 locked together in substantially parallel relationship as illustrated in FIG. 3. The locking pin 19 can be permanently attached, such as by a chain or a cable 48, to the portion 16.

Fixedly attached along substantially entire lengths of legs 2 and 4 of portions 16 and 18 are housing members 24 which are generally rectangular in cross-section. One side 52 of the housing members 24 has an opening 52 which receives an elongated leg of a T-shaped rail 20 therein. The transverse part of the T-shaped rail is slidably engaged within a central opening 58 of the housing members 24. The T-shaped rail is, in turn, fixedly attached to the legs of extension sections 30.

When the ladder 10 serves as an extension ladder, the extension sections 30 are telescopically moved up along the length of the portions 16 and 18 while the rails 20 are continuously engaged with the housing members 24.

A plurality of spaced-apart apertures are formed in the legs 2 and 4 of the portion 16 and 18 and of the extension sections 30. The apertures are large enough to receive a spring operated securing pin 40 therein. The pin 40 slides within a sleeve 62, which is formed with two spaced-apart holes 64 and 66 which are adapted to receive a locking finger 68 therein. The locking finger 68 is attached perpendicularly to a longitudinal axis of the pin 40. Mounted about exterior of the pin 40 is a compression spring 70 which urges at one of its ends against a wall 72 of the sleeve 62 and urges at its second end against a collar 74 which is secured on the outside of the pin 40 adjacent the finger 68. When the locking finger 68 extends through the hole 64 the pin 40 is in its securing position, securing extension sections 30 to the portions 16 and 18. When the pin is rotated, the locking finger is withdrawn from its protruding position through the hole 64 in the sleeve 62. The pin 40 is then pulled away by a handle 76, which is carried by an exterior end of the pin 40, compressing the spring and retracting the locking finger until it aligns itself with the hole 66. The pin 40 is then rotated again, forcing the locking finger 68 through the hole 66. In this manner, the extension sections 30 are disengaged from the portions 16 and 18. After that, the sections 30 can be moved along the portions 16 and 18, thus further elongating the length of the extension ladder or reducing it to the desired degree. Each aperture in the legs 2 and 4 of the portions 16 and 18 and sections 30 permits such variation in the length of the ladder 10.

It should be noted that the extension sections 30 are similar in construction with the portions 16 and 18. They all have parallel legs 2 and 4 and transverse rungs 8 which are preferably spaced an equal distance from each other.

If desired, the exterior surface of the legs 2 and 4 of the sections 30 can be made to carry housing members similar to the housing members 24 of the portions 16 and 18. T-shaped rails 20 of additional extension sections 30 can then be engaged in sliding relationship therewith, thus permitting even further telescopical extension of the length of the ladder 10. One such additional section is designated by numeral 35 in FIGS. 2 and 3.

As shown in FIG. 2, the ladder 10 rests in the legs 2 and 4 of the extension sections 30. The rungs of the portions 16 and 18 are aligned with each other, allowing to safely use the ladder 10 when climbing the ladder in its step ladder position. When the sections 30 are extended as illustrated in FIG. 3, one of the sections 30 is positioned on the ground and portions 16 and 18 are locked together forming one part of the extended ladder 10. Another section 30 is moved upwardly and locked in place above the portions 16 and 18, when further length is required. Still further sections 30 can be similarly extended to allow the user a considerable flexibility when selecting the length of the ladder.

Optionally, a shelf 6 can be attached in pivotal engagement to the portion 16. When pivoted in parallel relationship to top rung 14 and locked in place, the shelf 6 permits positioning of various tools and supplies within easy reach of the user. When the ladder is in its extended position (FIG. 3), the shelf folds down in parallel relationship to portion 16 so as not to interfere with sliding of the sections 30 along the portion 16.

The ladder of the present invention is preferably made of a lightweight, rust-proof material, such as aluminum and the like, to allow easy manipulation by one person.

Many changes and modifications can be made in the structure of the ladder without departing from the spirit of the invention. I, therefore, pray that my rights to the present invention be limited only by the scope of the appended claims.

I claim:

1. A convertible step/extension ladder, comprising:

a first frame portion;

a second frame portion pivotally attached to said first frame portion, each of said first and second portions comprising a pair of parallel leg members and a plurality of transverse spaced apart rungs fixedly attached to said leg members;

an elongated housing member carried by an exterior of each of the leg members, said housing member having a central opening therein;

at least one extension member having a pair of parallel leg members and a plurality of transverse spaced-apart rungs fixedly attached to the leg members;

an elongated rail member carried by an exterior of the extension leg members, said rail member being slidably engaged within the central opening of the housing member to allow telescopic movement of the extension members along exterior of the frame portion;

means for locking the first and the second frame portions in substantially parallel relationship to each other when the ladder is converted from a step ladder to an extension ladder.

2. The apparatus of claim 1, further comprising means for securing the extension member to the housing member at a predetermined position.

3. The apparatus of claim 2, wherein said securing means comprises an elongated sleeve fixedly attached at one of its ends to the housing member, a tension spring operated securing pin slidably received in said sleeve and movable between a first locking position and a second released position.

4. The apparatus of claim 3, wherein said sleeve is provided with a pair of spaced apart apertures formed in a sidewall of the sleeve, and wherein said securing pin is provided with a locking finger extending in perpendicular relationship to a longitudinal axis of the pin, said finger being engageable within a pre-selected aperture of the sleeve to secure or to release the extension member in its attachment to the housing member.

5. The apparatus of claim 1, comprising a first and a second extension members carried by respective frame portions and wherein said first extension members are adapted for sliding in opposite directions when said step ladder is converted to an extension ladder, such that the first extension member becomes a lower support for the extension ladder, while the second extension member extend at least in part above said frame members.

6. The apparatus of claim 5, wherein said frame members, when locked, form a middle part of the extension ladder.

7. The apparatus of claim 1, further comprising a top step extending between the first and the second frame portions, said top step being in substantially parallel relationship to said rungs of the ladder.

8. The apparatus of claim 1, further comprising a spreader bar having a pair of sections, each pivotally attached to a frame portion at one of its ends and pivotally attached to another section at its other end.

9. A method for converting a step ladder to an extension ladder comprising the steps of:

providing a first frame portion having a pair of parallel legs and a plurality of transverse spaced-apart rungs;

providing a second frame portion having a pair of parallel legs and a plurality of transverse spaced-apart rungs, said second portion being hingedly attached to said first portion about an upper part thereof for a limited pivotal movement between a first position when the frame portions are angularly positioned in relation to each other to form an A-frame, and a second folded position when the frame portions are in substantially parallel relationship to each other;

providing means for locking the frame portions in a selected first or second position;

providing an elongated housing member carried by an exterior of each of the legs;

providing at least one extension member having a pair of parallel legs and a plurality of spaced-apart transverse rungs, said extension member further having an elongated rail member carried by an exterior of each of the legs of the extension member;

engaging the rail member within a central opening of the housing member in sliding relationship thereto;

securing the extension member to the frame portion when the ladder is in its first position to prevent sliding of the extension member along the frame portion;

locking the frame portions in their second position;

disengaging the extension member from its secured relationship to the frame member;

sliding the extension member along the frame portion while engaging the rail member in the housing member;

locking the extension member to the frame portion when the extension member reaches its pre-selected position, thereby converting the step ladder to an extension ladder.

10. The method of claim 9, further comprising a step of providing a securing means for securing the extension member to the frame portion in a pre-selected position.

11. The method of claim 10, wherein said securing means comprises an elongated sleeve fixedly attached at one of its ends to the housing member, and a tension spring operated securing pin slidably received in said sleeve and movable between a first locked position and a second released position.

12. The method of claim 11, wherein said sleeve is provided with a pair of spaced-apart apertures formed in a sidewall of the sleeve, and wherein said securing pin is provided with a locking finger extending in perpendicular relationship to a longitudinal axis of the pine, said finger being engageable within a pre-selected aperture of the sleeve to secure or to release the extension member in its attachment to the housing member.

13. The method of claim 9, comprising the step of providing a pair of extension members, each carried by its respective frame member.

14. The method of claim 13, wherein said step of sliding the extension member along the frame portion comprises the steps of:

sliding one extension member along the frame portion such that the extension member becomes a support of the extension ladder adapted for resting on a ground;

sliding another extension member along the frame portion in an opposite direction, extending the extension member, at least in part, above the frame portion, while locking the frame portions in the second folded position, such that the locked frame portions form a middle part of the extension ladder.

* * * * *